US006647749B2

(12) United States Patent
Ikoma

(10) Patent No.: US 6,647,749 B2
(45) Date of Patent: Nov. 18, 2003

(54) YARN FEEDING DEVICE OF FLAT KNITTING MACHINE

(75) Inventor: Kenji Ikoma, Wakayama (JP)

(73) Assignee: Shima Seiki Mfg., Ltd., Wakayama (JP)

( * ) Notice: Subject to any disclaimer, the term of this patent is extended or adjusted under 35 U.S.C. 154(b) by 0 days.

(21) Appl. No.: 10/220,043

(22) PCT Filed: Feb. 26, 2001

(86) PCT No.: PCT/JP01/01440

§ 371 (c)(1),
(2), (4) Date: Aug. 27, 2002

(87) PCT Pub. No.: WO01/64989

PCT Pub. Date: Sep. 7, 2001

(65) Prior Publication Data

US 2003/0037575 A1 Feb. 27, 2003

(51) Int. Cl.[7] ..... D04B 15/52
(52) U.S. Cl. ..... 66/126 A; 66/126 R
(58) Field of Search ..... 66/126 R, 126 A, 66/128, 129, 130, 133, 138, 139, 131, 125 R, 127

(56) References Cited

U.S. PATENT DOCUMENTS 5,031,423 A * 7/1991 Ikenaga ..... 66/126 R
5,345,789 A * 9/1994 Yabuta ..... 66/126 A
5,544,502 A * 8/1996 Nakamori et al. ..... 66/126 A

* cited by examiner

*Primary Examiner*—Danny Worrell
(74) *Attorney, Agent, or Firm*—Rothwell, Figg, Ernst & Manbeck

(57) ABSTRACT

A yarn carrier comprises a carrier base, a reciprocator, a feeder, and a movement converter. The reciprocator is supported on the carrier base to move in reciprocation with a traveling direction of the carrier base. An engaging surface is temporarily engageable with an accompanying member of a carrier accompanying device. The feeder, has a main-yarn feeding hole and a plating-yarn feeding hole, and supports at least one of the yarn feeding holes to freely rotate about an axis in a longitudinal direction of the feeder. The movement converter converts reciprocating movement of the reciprocator into rotation movement of the yarn feeding holes provided in the feeder, such that when the reciprocator is moved with its engaging surface engaged with the accompanying member, the yarn feeding holes can be rotationally displaced to change a positional relationship between the main-yarn feeding hole and the plating-yarn feeding hole.

2 Claims, 12 Drawing Sheets

10－a

10－b

10－c

Prior Art

YARN FEEDING DEVICE OF FLAT KNITTING MACHINE

TECHNICAL FIELD

The present invention relates to a yarn feeding device of a flat knitting machine used for plating.

BACKGROUND ART

When plating is performed by using a flat knitting machine, a plating carrier or equivalent is used for knitting. The plating carrier has, at a lower end thereof, yarn feeding means having a hole for a main yarn shown as a front yarn to pass through and a hole for a plating yarn shown as a back yarn to pass through, respectively. In plating, the yarns are aligned in the yarn feeding means and fed therefrom to knitting needles in the feeding order of the main yarn and the plating yarn with respect to a traveling direction of a carrier so that the main yarn can show on the front side of the fabric.

As shown in FIG. 14, some known plating carriers have yarn feeding means 200 having, at a center portion thereof, a hole 202 of circular cross section for the main yarn to pass through and an arched slot 204, encircling the circular hole 202 in semicircular, for the plating yarn to pass through. The plating carrier of this type is so designed that when the carrier changes in traveling direction, the plating yarn can pass through the arched slot 204, so that the main yarn and the plating yarn are caused to change over positions, depending on the traveling direction of the carrier.

The other known plating carriers have yarn feeding means 206 having a hole 208 for the main yarn to pass through and a hole 210 for the plating yarn to pass through, as shown in FIG. 15 showing a front view of the yarn feeding means 206. The plating carrier of this type is so designed that the yarn feeding means 206 can be reversed 180 degree to cause the main yarn and the plating yarn to change over positions with respect to the traveling direction of the carrier.

The means for reversing the yarn feeding means 206 that may be used include, for example a rack-and-pinion. Also, the means for moving the rack in reciprocation that may be used include, for example, friction resistance against a yarn guide rail and a motor drive.

The means for reversing the yarn feeding means by the motor drive is known from Japanese Laid-open (Unexamined) Patent Publication No. Sho 51(1976)-23352. This publication discloses a yarn feeding device wherein a gear is rotated by a pawl mounted on a rail of the knitting machine body, to turn on a micro switch to drive the motor, whereby the rack is moved in reciprocation to rotate the pinion so as to rotate the yarn feeding means 180 degree.

According to (i) the former conventional plating carrier wherein the yarn feeding means 200 having the circular hole 202 for the main yarn to pass through and the arched slot 204, encircling the circular hole 202 in a semicircular, for the plating yarn to pass through are so designed that when the carrier changes in traveling direction, the plating yarn can pass through the arched slot 204 to cause the main yarn and the plating yarn to change over positions in the traveling direction of the carrier and (ii) the latter conventional plating carriers wherein the yarn feeding means 206 at the lower end portion of the plating carrier is reversed through the use of friction resistance against yarn guide rail or equivalent, to cause the main yarn and the plating yarn to change over positions in the traveling direction of the carrier, the positions of the main yarn and the plating yarn depend on the traveling direction of the carrier.

Consequently, these conventional plating carriers cannot be used, for example, in such a knitting that the plating yarn shows on the front side of the fabric in the process of knitting, in order to change the pattern in the middle of the knitting width.

In the case of the plating carrier wherein the yarn feeding means is reversed by the motor drive, as disclosed by Japanese Laid-open (Unexamined) Patent Publication No. Sho 51(1976)-23352, the pawl serving to drive the motor to rotate the yarn feeding means must be mounted in advance on the yarn guide rail. In addition, although this plating carrier can be used for knitting a fabric having some regular pattern, such as a checkered pattern or a striped pattern, this plating carrier does not enable the main yarn and the plating yarn to change over positions at any desired positions, when knitting a fabric of such a pattern that the location at which the yarn feeding means is reversed varies depending on the knitting courses. Besides, a dedicated motor for reversing the yarn feeding means must be incorporated and, as a result of this, the yarn carrier is complicated and increased in size and weight.

In the light of the drawbacks mentioned above, the present invention has been made. It is the object of the invention to provide a yarn feeding device of a flat knitting machine that enables yarn feeding means of a yarn carrier to be reversed at any selective location, irrespective of the direction of knitting.

DISCLOSURE OF THE INVENTION

The present invention provides a yarn feeding device of a flat knitting machine comprising at least a pair of front and back needle beds which are so disposed that their front ends confront each other in an abutment relation; a number of knitting needles arranged in line on the needle beds in such a manner as to be freely advanced and retracted; a yarn guide rail arranged over the needle beds to extend in parallel with a longitudinal dimension of the needle beds; a yarn carrier for feeding a yarn to the knitting needle which is movably arranged in the yarn guide rail; carrier accompanying means including an accompanying member for releasing the yarn carrier from accompaniment at any position of the needle beds, the yarn carrier comprising:

a carrier base having, at an upper end thereof on the center side, an engaging portion engageable with the accompanying member of the carrier accompanying means and supported on the yarn guide rail in such a manner as to move in reciprocation along the longitudinal dimension of the needle beds;

reciprocating means supported on the carrier base in such a manner as to move in reciprocation with respect to a traveling direction of the carrier base and having, at an outside of the engaging portion of the carrier base with respect to the traveling direction, an engaging surface temporarily engageable with the accompanying member of the carrier accompanying means;

feeder means having, at its front end, a main-yarn feeding hole and a plating-yarn feeding hole, extending vertically downwardly from the carrier base, and supporting at least one of the yarn feeding holes in such a manner as to freely rotatable about an axis in a longitudinal direction of the feeder means; and movement conversion means for converting reciprocating movement of the reciprocating means into rotation movement of the yarn feeding holes provided in the feeder means in such a manner that when the reciprocating means is moved with its engaging surface engaged with the accompanying member, the yarn feeding holes of the feeder means can be rotationally displaced to change a positional relationship between the main-yarn feeding hole and the plating-yarn feeding hole over a needle bed gap between the needle beds, wherein the carrier accompanying means is electrically controlled so that when the yarn carrier is accompanied by the accompanying member and/or is released from the accompaniment, the carrier accompanying means can be selectively engaged with or disengaged from the engaging surface of the reciprocating means.

It is preferable that the movement conversion means comprises a rotary cam that is rotated by movement of the reciprocating means and an auxiliary rotary cam arranged under or over the rotary cam; the rotary cam is rotated a predetermined turn by the movement of the reciprocating means; and then the rotary cam or the auxiliary rotary cam is vertically moved to bring the auxiliary rotary cam into abutment with the rotary cam, whereby the rotary cam is rotated the remaining turn until the feeder means is reversed.

BEST MODE FOR CARRYING OUT THE INVENTION

In the following, certain preferred embodiments of the present invention will be described with reference to the accompanying drawings.

(Embodiment 1)

Figure 1:
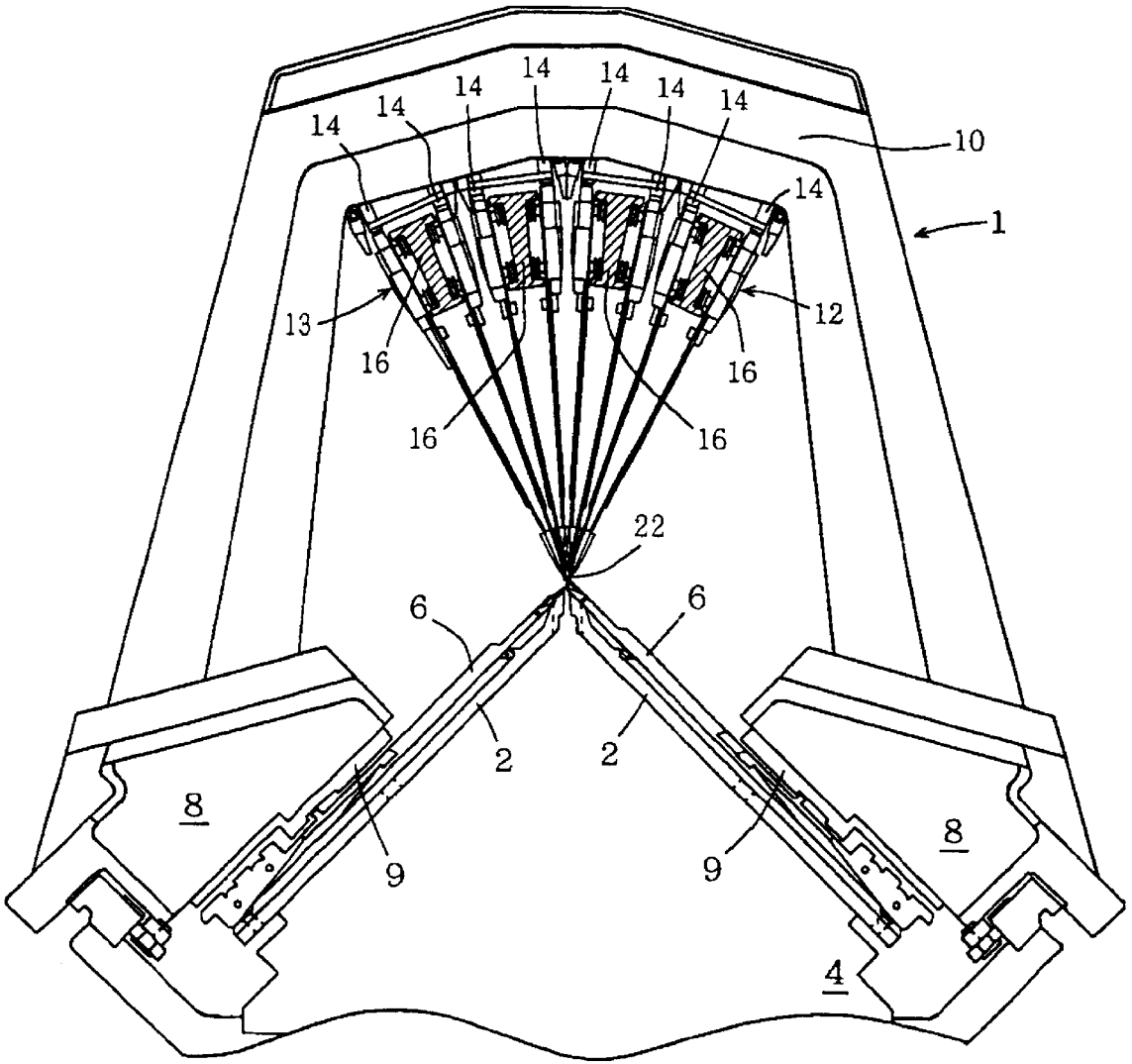
FIG. 1 shows a side view of a yarn feeding device of a flat knitting machine of the present invention.

FIG. 1 shows a side view of a yarn feeding device of a flat knitting machine of the present invention. In the illustration, reference numeral 1 shows an entirety of the flat knitting machine.

In the flat knitting machine 1, a pair of front and back needle beds 2 is mounted on a flame 4 in an inverted V-shape arrangement with their front ends confronting each other. A number of knitting needles 6 are arranged in line on the respective needle beds 2 so as to be controllably advanced and retracted. Carriages 8 are moved in reciprocation on their respective needle beds 2 via drive means, not shown, and knitting cams 9 mounted on the carriages 8 act to actuate the knitting needles 6 to be advanced and retracted. The carriages 8 are provided with a gate arm 10 bridging the front and back needle beds 2 to integrally connect therebetween, and the gate arm 10 is equipped with carrier means 14 to take in yarn carriers 12.

Four yarn guide rails 16 extending longitudinally of the needle beds 2 are arranged over the needle beds 2 and between support brackets, not shown, at both ends of the knitting machine, so as to radiate with respect to a front-and-back direction of the needle beds 2 with a central focus on a position close to front ends of the knitting needles 6 arranged in line on the needle beds 2. The yarn carriers 12 and plating carriers 13 used for plating are properly supported on the yarn guide rails 16, so as to be movable therealong.

Each plating carrier 13 is provided, at lower end portion thereof, with a yarn feeding portion 22 having a main-yarn guide hole 18 and a plating-yarn guide hole 20 which are for guiding the main yarn and the plating yarn, respectively. In plating, the main-yarn guide hole 18 and the plating-yarn guide hole 20 of the yarn feeding portion 22 are arrayed in accordance with the carrier moving direction, so as to draw the yarns in regular order of the main yarn and the plating yarn and feed them to the needles 6 so that the main yarn can show on the front side of the fabric. When the carriages 8 are reversed in traveling direction, the yarn feeding portion 22 is rotated a 180° turn about an axis of the longitudinal direction of the carrier orthogonal to the traveling direction of the carrier, to cause the main-yarn guide hole 18 and the plating-yarn guide hole 20 to change over positions, so as to feed the yarns from the yarn feeding portions 22 to the needles in the order of the main yarn and the plating yarn.

Hereinafter, this turning of the yarn feeding portion 22 is simply referred to the reverse of the yarn feeding portion 22.

Although two needle beds are illustrated in the embodiments, for example three needle beds may be used, without limiting to the two needle beds.

Figure 2:
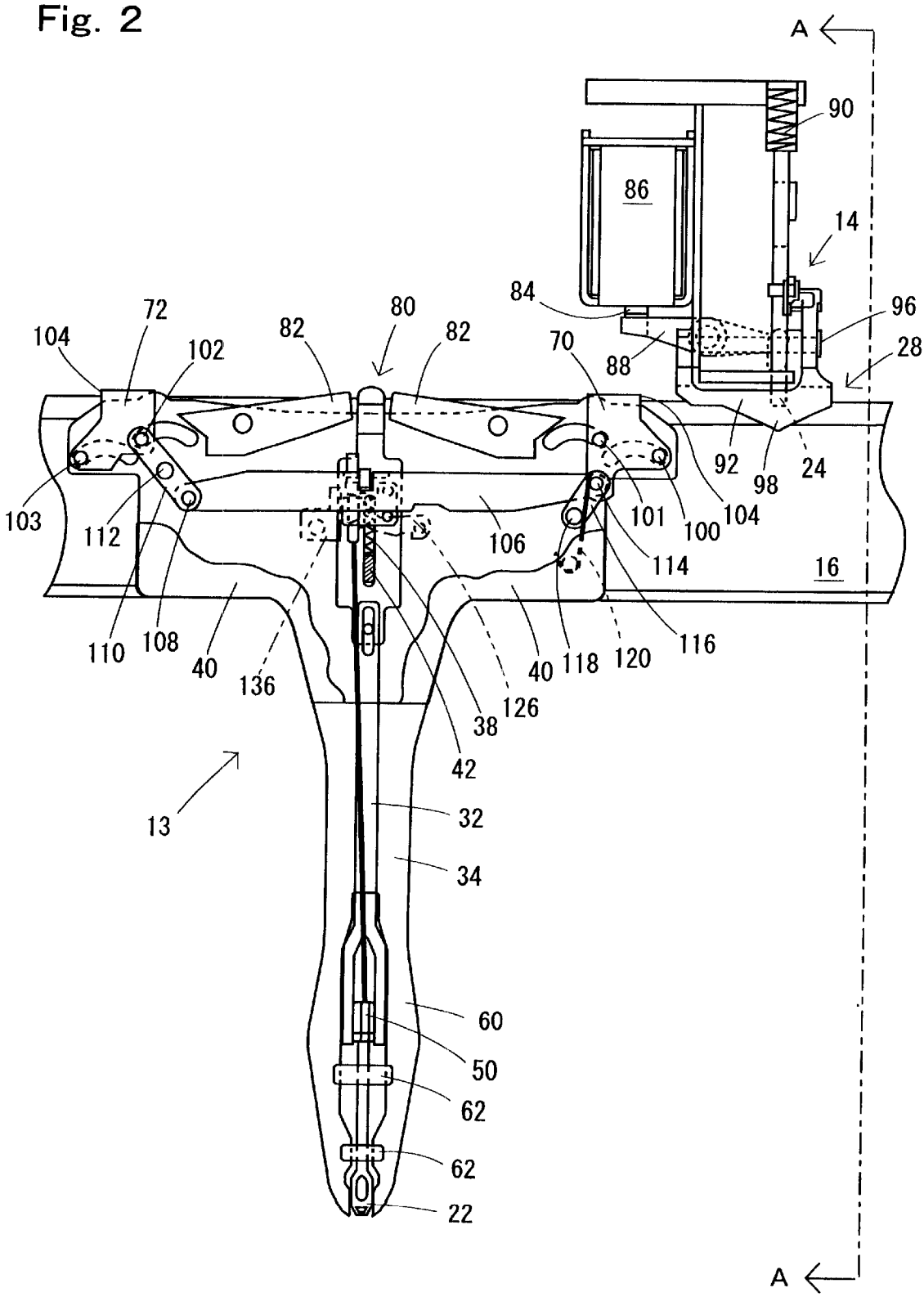
FIG. 2 shows the yarn feeding device whose yarn feeding means is not in the reversed state.
Figure 3:
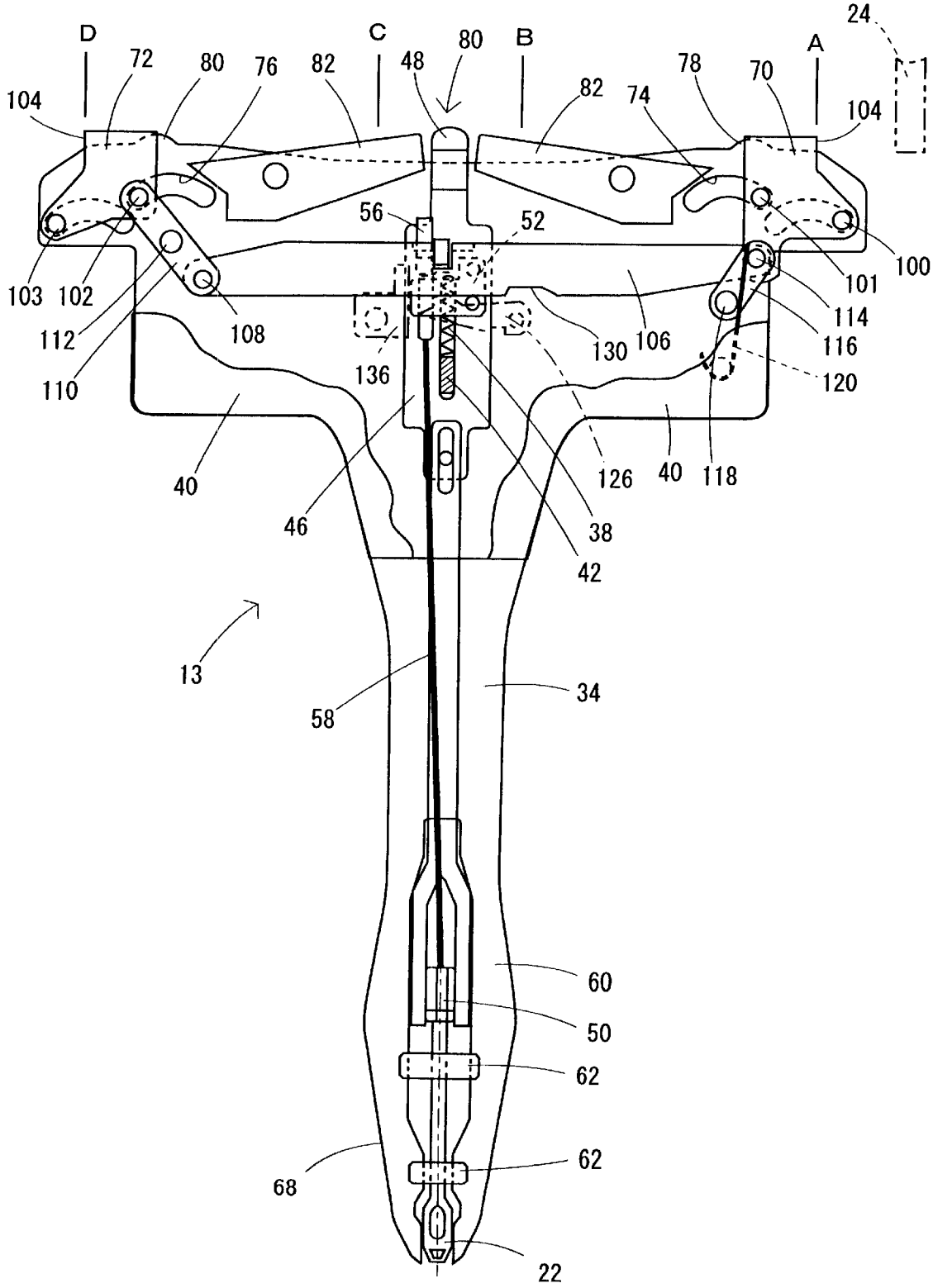
FIG. 3 is an enlarged view of a plating carrier of FIG. 2.
Figure 4:
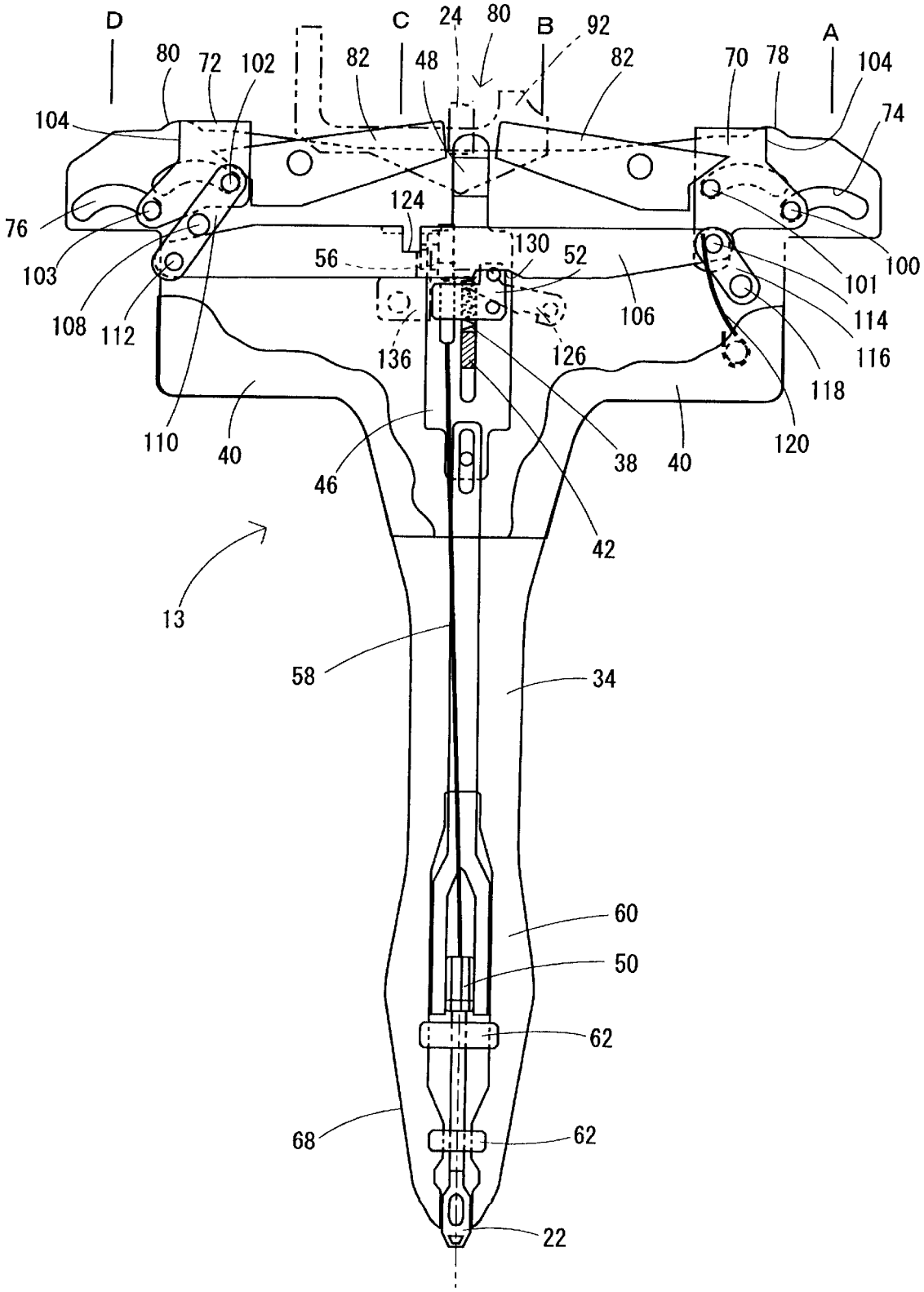
FIG. 4 shows the plating carrier whose yarn feeding means is in the reversed state.
Figure 5:
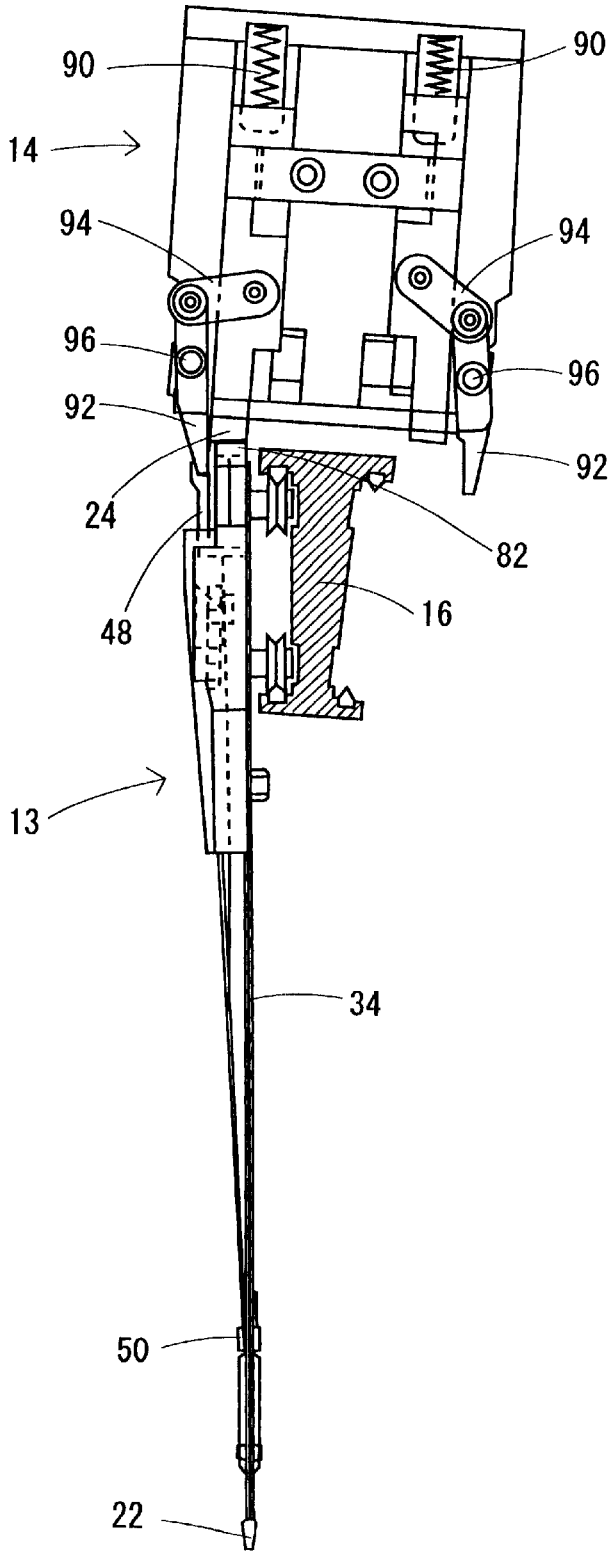
FIG. 5 shows a side view of the yarn feeding device taken along line A—A of FIG. 2.

FIG. 2 is a front view of the yarn feeding device, partly drawn in perspective, which is in the initial state in which its yarn feeding portion is not in the reversed state. FIG. 3 is an enlarged view of the plating carrier 13 of FIG. 2, and FIG. 4 shows the yarn feeding portion 22 which is in the reversed state. FIG. 5 is a side view of the yarn feeding device taken along line A—A of FIG. 2.

The yarn feeding device comprises the plating carrier 13, supported on the yarn guide rail 16 in a movable manner, to feed the yarns to the knitting needles 6; carrier accompanying means 14, placed on the gate arm 10 of the carriage 8, for accompanying the plating carrier 13 via a accompanying member 24 which is controllably advanced and retracted; and lowering means 28 for lowering the yarn feeding portion 22 provided at the lower end of the plating carrier 13 down to a position close to the front end of the knitting needle 6.

Figure 6:
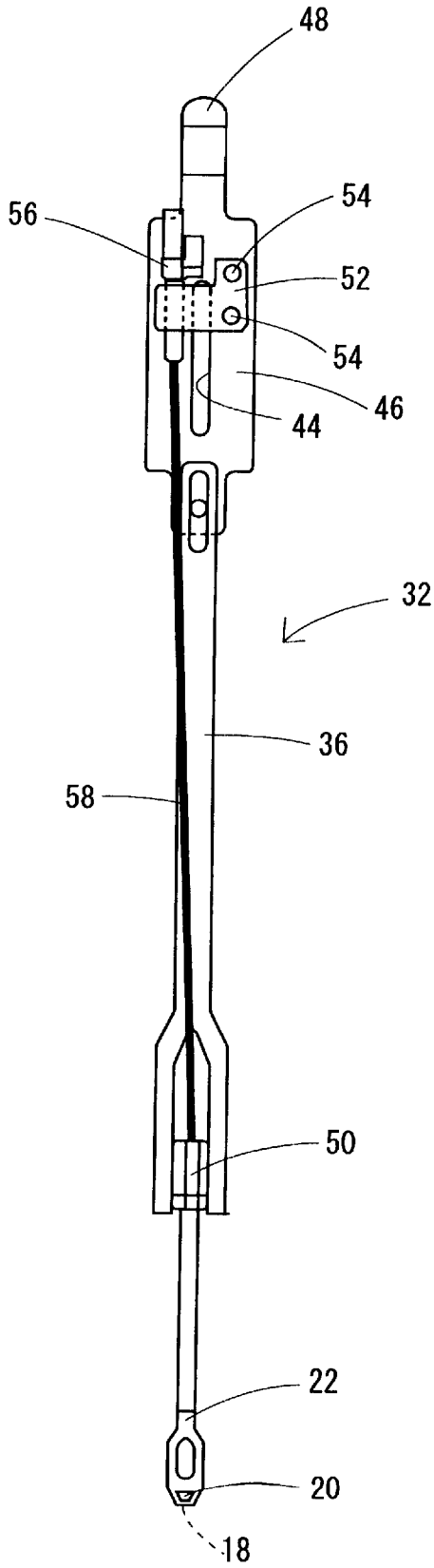
FIG. 6 shows a feeder rod.
Figure 7:
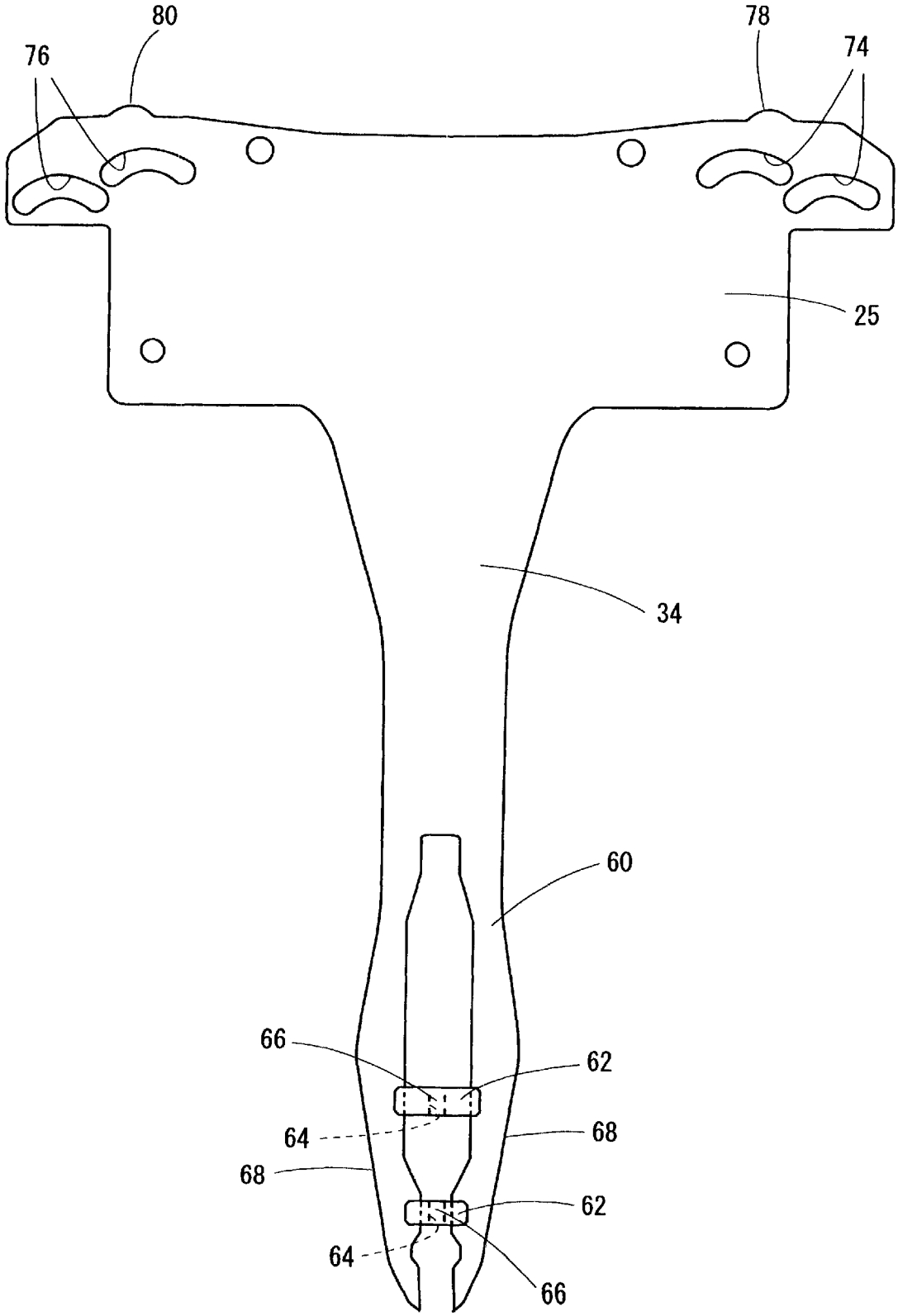
FIG. 7 shows a feeder rod guide.

A carrier base 25 of the plating carrier 13 includes a feeder portion which comprises a vertically movable feeder rod 32 and a feeder rod guide 34, extending from the carrier base 25, to guide the feeder rod 32 at a lower end portion thereof FIGS. 6 and 7 show the feeder rod 32 and the feeder rod guide 34 which form the feeder portion.

The feeder rod 32 comprises an elongated plate-like rod portion 36; a spring 38 fitted in an upper portion of the rod portion 36 as an elastic member for biasing the feeder rod 32 upwardly; an upward biasing portion 46 in which a vertical slot 44 for passing therethrough a lug 42 of a feeder case 40 supporting a lower end of the spring 38 is formed; and a depressing portion 48, provided at the head of the upward biasing portion 46, to be abuttable against the lowering means 28. The lower end of the rod portion 36 is fitted with a joint 50. The yarn feeding portion 22 having the main-yarn guide hole 18 and the plating-yarn guide hole 20 is mounted on a lower end of the joint 50 in such a manner as to be rotated by the rotation of the joint 50.

A cam mount 52 is fixed to the upward biasing portion 46 with screws 54, and a rotary cam 56 serving as movement conversion means is mounted on the cam mount 52, mentioned later, so as to rotate about an axis parallel with the longitudinal direction of the carrier. The rotary cam 56 and the joint 50 mounted on the lower end of the rod portion 36 are connected with each other via a shaft 58 so that the rotation of the rotary cam 56 is transmitted to the joint 50 via the shaft 58.

The feeder rod guide 34 is formed from a thin metal plate having an adequate elasticity and hardness into a shape to have a width larger than the feeder rod 32, particularly, have a widened portion 60 at a lower end portion thereof. The feeder rod guide 34 is provided, at a lower end portion thereof, with guide portions 62 for guiding the feeder rod 32. Each guide portion 62 is formed to have a thru hole 64 for guiding the feeder rod 32. The guide portion has smooth buffer surfaces 66 having a given thickness formed on the front and back surfaces of the carrier so that when the plating carrier 13 is crossed and contacted with another yarn carrier 12, the buffer surfaces 66 can act to reduce the impact and push away the each other's yarn carriers.

Also, the feeder rod guide 34 has carrier escaping portions 68 formed at both sides of the lower widened portion 60 of the feeder rod guide 34. The carrier escaping means 68 are tapered toward the lower end, so as to reduce the impact when the plating carrier 13 is moved via the carrier accompanying means 14 mentioned later and is crossed and contacted with another yarn carrier 12.

The carrier base 25 has two pairs of right and left arched slots 74, 76 formed at upper portions thereof, two in each pair, to slidably mount a pair of control arms 70, 72 against which the carrier accompanying means 14 of the carrier is abutted to reverse the yarn feeding portion 22 mentioned later. The carrier base 25 has lugs 78, 80 formed in pair at its top end mentioned later.

The feed rod guide 34 in the illustrated embodiment is formed in one piece so as to be integral with the carrier base 25, for reduction of parts counts and weight.

The plating carrier 13 is provided, at its top, an engaging portion 80 engageable with the accompanying member 24 to accompany the plating carrier 13 via the carrier accompanying means 14 mentioned later. The engaging portion 80 is formed by a pair of swinging arms 82 pivotally supported at the upper portions of the plating carrier 13 so as to be vertically swung. Each swinging arm 82 is biased upwardly at one end thereof on the central side of the carrier by a spring fitted in a groove formed in a feeder case 40, not shown, so as to be higher in position than the supporting point of the swinging arm 82.

The carrier accompanying means 14 comprises a solenoid 86 that permits an output shaft 84 to project and retract under control of output signals from a control unit, not shown, and a transmission rod 88 for transmitting the movement of the output shaft 84 of the solenoid 86 to the accompanying member 24. The accompanying member 24 is biased downwardly by a spring 90. The carrier accompanying means 14 brings the accompanying member 24 into engagement with the engaging portion 80 formed by the pair of swinging arms 82 at the upper end of the plating carrier 13 at locations close to the center thereof, so as to accompany the plating carrier 13.

The feeder rod 32 supports the upward biasing portion 46 so as to be vertically movable in the groove, not shown, formed in the feeder case 40 in the state in which the feeder rod 32 is upwardly biased by the spring 38 at a nearly center portion of the engaging portion 80 formed at the top of the plating carrier 13.

The lowering means 28 is provided with a cam plate 92 for pressing down the feeder rod 32. The cam plate 92 is connected with the accompanying member 24 of the carrier accompanying means 14 through a connecting plate 94. The cam plate 92 is so formed that it can swing front and back about an axis of a pivot pin 96 in association with the vertical movement of the accompanying member 24. Also, the cam plate 92 has, at its lower end portion, a depressing cam 98 formed to press down the depressing portion 48 of the feeder rod 32. When the cam plate 92 of the lowering means 28 presses down the feeder rod 32, the yarn feeding portion 22 provided at the lower end of the feeder rod 32 is projected beyond the front end of the feeder rod guide 34.

Now, reference will be made to the mechanism for selectively reversing the yarn feeding portion 22 provided at the lower end of the feeder rod 32.

The plating carrier 13 is provided, at top portions thereof, with a pair of right and left control arms 70, 72. The control arms 70, 72 are each provided with two pins 100; 101, 102; 103 with respect to the front and back direction of the carrier. These pins 100; 101, 102; 103 are inserted in their respective arched slots 74, 76 formed at both sides of the feeder rod guide 34 at upper portions thereof so that the control arms 70, 72 can be horizontally sliably fitted thereto.

The control arms 70, 72 are mounted in the positions outside of the pair of swinging arms 82 forming the engaging portion 80 of the plating carrier 13 in such a positional relationship that when the horizontally slidably mounted control arms 70, 72 are in the positions outside of the carrier, engaging surfaces 104 of the control arms 70, 72 with the accompanying member 24 of the carrier accompanying means 14 formed at the side surfaces of the carrier at the outside thereof become higher than the right and left upper ends of the carrier base 25, so that when the carrier accompanying means 14 lowers the accompanying member 24 down to the position close to the plating carrier 13, the side surfaces of the accompanying member 24 are engaged with the engaging surfaces of the control arms 70, 72.

When the movably mounted control arms 70, 72 are moved toward the center of the carrier, the engaging surfaces 104 formed on the upper side surfaces of the control arms 70, 72 at the outside of the carrier are slightly out of the centers of the lugs 78, 80 formed on the top of the carrier base 25 toward the center of the carrier. At this time, the upper ends of the control arms 70, 72 are level with or lower than the lugs 78, 80 formed on the top of the carrier base 25.

The pair of right and left control arms 70, 72 provided on the upper portion of the plating carrier 13 are connected with each other via a linkage mechanism using a control-arm connecting plate 106. The control arm 72 and the control-arm connecting plate 106 at the left side of the carrier are swingably attached to both end portions of a lever 110 by a pin 102 provided in the control arm 72 and a pin 108 provided in the control arm connecting plate 106 at the left end thereof, first. A center portion of the lever 110 is pivotally supported on the carrier base 25 by a fixing pin 112. The control arm 70 and the control-arm connecting plate 106 at the right end of the carrier are swingably attached to a right end portion of the control-arm connecting plate 106 by a pin 114 provided at the lower end portion of the control arm 70. Further, one end of the lever 116 is swingably attached thereto by the pin 114 provided in the control arm 70 and the other end of the lever 116 is pivotally supported on the carrier base 25 at a portion thereof below the control arm 70 by a fixing pin 118.

In the illustrated embodiment, the control arm 70 is always biased toward the right of the carrier by a spring 120. Since the right and left control arms 70, 72 are connected with each other by the linkage mechanism, the one control arm 72 is always biased toward the left of the carrier.

Also, since the pair of right and left control arms 70, 72 provided on the upper portion of the plating carrier 13 are connected with each other by the linkage mechanism as mentioned above, slidable movement of either of the right and left control arms 70, 72 causes the control-arm connecting plate 106 interconnecting the pair of right and left control arms 70, 72 to slidably move toward the left.

Thus, in the illustrated embodiment, reciprocating means comprises the pair of right and left control arms 70, 72 and the control-arm connecting plate 106 interconnecting the control arms 70, 72.

Figure 8:
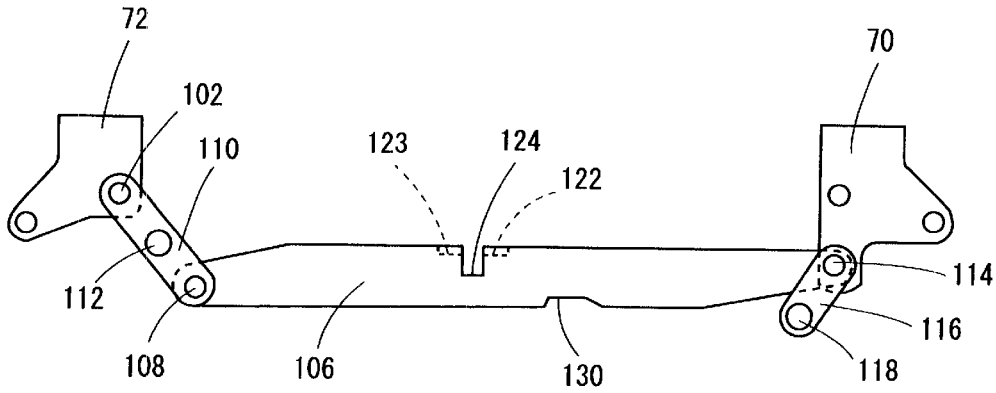
FIG. 8 is a front view of an arrangement of control arms and a control-arm connecting plate.
Figure 9:
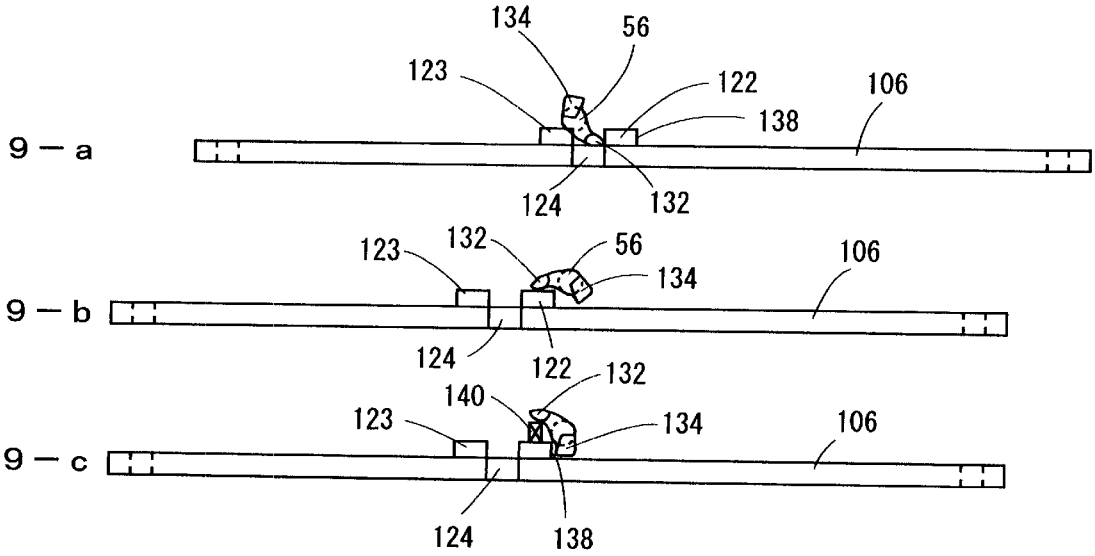
FIG. 9 shows top views of the control-arm connecting plate and a rotary cam.
Figure 10:
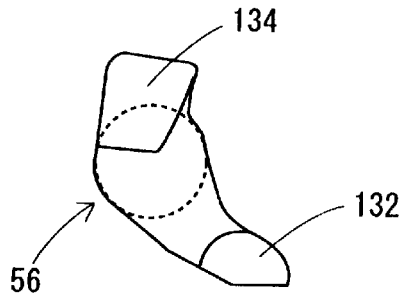
FIG. 10 shows the rotary cam.
Figure 10:
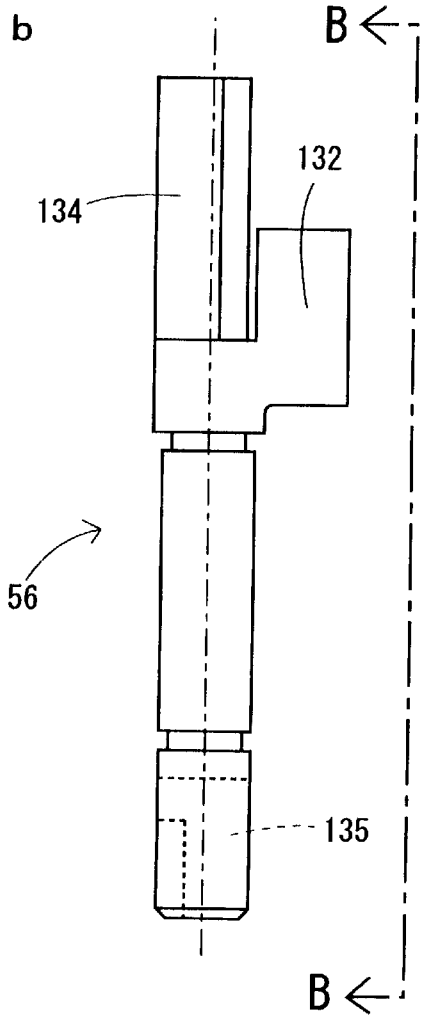
Figure 10:
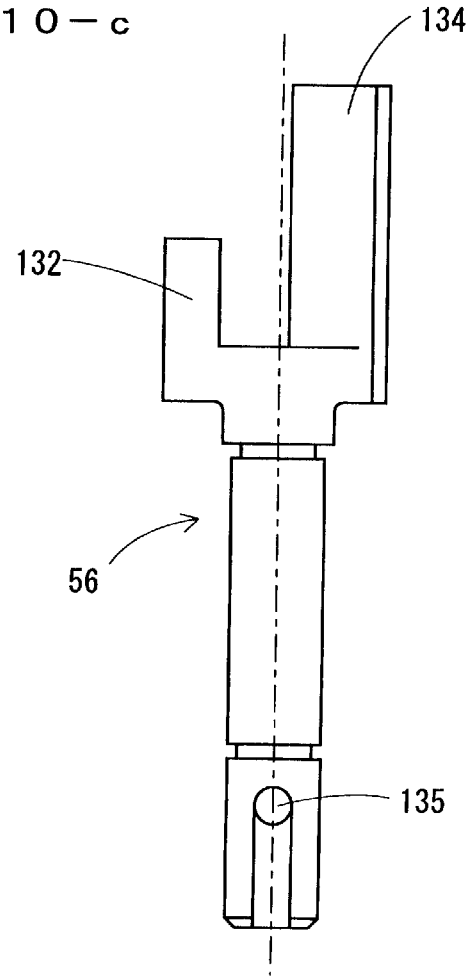

FIG. 8 is a front view of an arrangement of the control arms 70, 72 interconnected by the linkage mechanism and a control-arm connecting plate 106; and FIG. 9 shows top views of the control-arm connecting plate 106 and the rotary cam 56 mounted on the upward biasing portion 46 of the feeder rod 32 loosely fitted in the control-arm connecting plate 106. FIG. 10 shows top views of the rotary cam 56 for reversing the yarn feeding portion 22. FIG. 10-*a* is a top view of the rotary cam 56; FIG. 10-*b* is a side view of the rotary cam 56; and FIG. 10-*c* is a view of the rotary cam 56 as viewed from a B—B direction of FIG. 10-*b*.

The control-arm connecting plate 106 has a cut-off portion 124 formed in its upper surface at a center thereof and lugs 122, 123 formed on its rear surface portion so as to confront each other across the cut-off portion 124.

Figure 11:
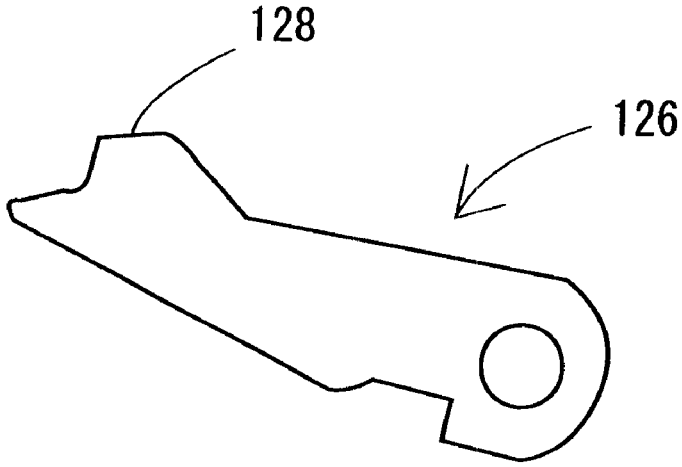
FIG. 11 shows a retaining portion of the connecting plate.

The control-arm connecting plate 106 has a recess 130 formed in its lower surface in which an engaging arm 128 of a connecting-plate retaining portion 126 shown in FIG. 11 is engaged. The connecting-plate retaining portion 126 is mounted in the feeder case 40 so as to be upwardly biased by a spring not shown.

The rotary cam 56 has, at its upper portion, a first rotary cam 132, which is formed so as to be loosely fitted in between the two lugs 122, 123 formed on an upper end of the control-arm connecting plate 106, so as to cause the rotary cam 56 to rotate by the sliding movement of the control-arm connecting plate 106 in the horizontal direction, and a connecting-plate rocking cam 134 extending upwardly beyond the first rotary cam 132.

As a result of the leftward shift of the control-arm connecting plate 106, the first rotary cam 132 loosely fitted in between the two lugs 122, 123 formed on the upper end of the control-arm connecting plate 106 is rotated the 90° turn in the clockwise direction as viewed from the top of the carrier. The cut-out portion 124 formed in the upper surface of the control-arm connecting plate 106 at a center thereof serves to prevent the front end of the first rotary cam 132 from abutting with the control-arm connecting plate 106 when the first rotary cam 132 of the rotary cam 56 is rotated.

The rotation of the first rotary cam 132 is transmitted to the joint 50 through the shaft 58 fitted in a shaft fitting hole 135 of the rotary cam 56, and as such can allow the yarn feeding portion 22 mounted on the joint 50 to rotate the 90° turn in the clockwise direction as viewed from the top of the carrier. The leftward movement of the control-arm connecting plate 106 brings the engaging arm 128 of the connecting-plate retaining portion 126 mounted in the feeder case 40 into engagement in the recess 130 formed in the lower end of the control-arm connecting plate 106, so that the control-arm connecting plate 106 is locked in that position against the biasing force of the spring.

When the feeder rod 32 is lowered, the cam mount 52 on which the rotary cam 56 is rotatably mounted allows the connecting-plate retaining portion 126 to swing downwardly, so as to release the engagement between the control-arm connecting plate 106 and the engaging arm 128 of the connecting-plate retaining portion 126. Although the control-arm connecting plate 106 is then intended to move rightward by the biasing force of the spring, since the connecting-plate locking cam 134 is put in abutment with a right side surface 138 of the right-side lug 122 on the upper end of the control-arm connecting plate 106 by the rotation of the rotary cam 56 caused by an auxiliary rotary cam 136 mentioned later, the control-arm connecting plate 106 is held in place against the biasing force of the spring in the control-arm connecting plate 106 by the connecting-plate locking arm 134 of the rotary cam 56 even when the engagement between the control-arm connecting plate 106 and the engaging arm 128 of the connecting-plate retaining portion 126 is released.

Figure 12:
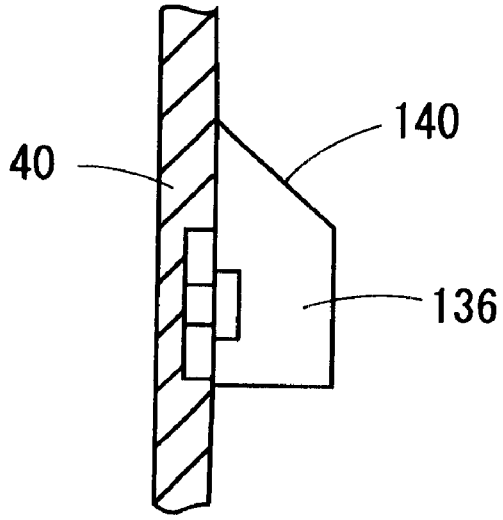
FIG. 12 shows an auxiliary rotary cam.

The auxiliary rotary cam 136 having a cam surface 140 shown in FIG. 12 that acts on the rotary cam 56 to cause the yarn feeding portion 22 to rotate the remaining 90° turn until the yarn feeding portion 22 is reversed is provided in the inside of the feeder case 40 at the location under the first rotary cam 132 of the rotary cam 56 rotated by the leftward shift of the control-arm connecting plate 106.

As the carrier accompanying means 14 accompanies the plating carrier 13, the cam plate 92 of the lowering means 28 presses down the upper end of the depressing portion 48 of the feeder rod 32. Since the rotary cam 56 is mounted on the upward biasing portion 46 of the feeder rod 32, the lowering of the feeder rod 32 causes the rotary cam 56 to be lowered down. When feeder rod 32 is lowered in the state in which the control-arm connecting plate 106 is shifted leftwards to cause the rotary cam 56 to rotate the 90° turn, the first rotary cam 132 of the rotary cam 56 is abutted with the cam surface 140 of the auxiliary rotary cam 136. When the feeder rod 32 is lowered further, the first rotary cam 132 acts on the yarn feeding portion 22 to cause the yarn feeding portion 22 to be rotated the remaining turn until it is revered.

Now, description will be given on the yarn feeding device and the flat knitting machine to control the yarn feeding device in the illustrated embodiment with reference to FIGS. 3 and 4 schematically showing the front view of the plating carrier 13 and FIG. 9 showing the top views of the control-arm connecting plate 106 and the rotary cam 56. FIG. 9-*a* shows the state of the yarn feeding portion 22 at the lower end of the plating carrier 13 before reverse; and FIG. 9-*b* shows the state in which the control arms 70, 72 arranged at the upper portion of the plating carrier 13 are slidably moved by the accompanying member 24 of the carrier accompanying means 14. FIG. 9-*c* shows the state in which the rotary cam 56 as was caused to rotate by the shift of the control-arm connecting plate 106 is rotated further by the lowering of the feeder rod 32.

First, description will be given on the case where the plating carrier 13 is accompanied by the carrier accompanying means 14 mounted on the carriage 8 without reversing the yarn feeding portion 22.

For the accompanying of the plating carrier 13, the carriage 8 is traveled and the accompanying member of the carrier accompanying means 14 is lowered under control of output signals from the control unit, not shown. The accompanying member 24 is lowered at the time at which the accompanying member 24 is between A–B of FIG. 3 when the plating carrier 13 is accompanied leftwards. On the other hand, the accompanying member 24 is lowered at the time at which the accompanying member 24 is between D–C of FIG. 3 when the plating carrier 13 is accompanied rightwards.

The cam plate 92 of the lowering means 28 is swung about the axis of the pivot pin 96 in the direction of the plating carrier 13 in association with the lowering of the accompanying member 24.

When the carriage 8 is traveled further, the depressing cam 98 formed on the lower end of the cam plate 92 is brought into abutment with the top of the depressing portion 48 of the feeder rod 32, so as to press down the feeder rod 32. This causes the yarn feeding portion 22 to project from the tip of the feeder rod guide 34 so that when the yarn feeding portion 22 at the lower end of the feeder rod 32 is projected to the position at which the yarn is fed to the knitting needle, the yarn feeding portion 22 can be in the position close to the front end of the knitting needle 6.

The lower end of the accompanying member 24 projected is brought into abutment with the upper surface of the swinging arm 82 positioned upstream with respect to the traveling direction of the carriage 8, of the pair of right and left swinging arms 82, 82 arranged at the upper portion of the plating carrier, to cause the one end of the swinging arm 82 located at the center side of the carrier to be swung downwardly.

When the accompanying member 24 projects into the engaging portion 80 formed by the swinging arms 82, 82, the one end of the swinging arm 82 positioned upstream with respect to the traveling direction of the carriage and located at the center side of the carrier is returned to its original position. Then, when the side surface of the accompanying member 24 is abutted with the side surface of the swinging arm 82 positioned downstream with respect to the traveling direction of the carriage 8 and located at the center side of the carrier, the plating carrier 13 is put into the state of being accompanied by the carriage 8. In this state, the yarn is fed from the yarn feeding portion 22 of the plating carrier 13 to the knitting needle 6.

When the plating carrier 13 is accompanied without reversing the yarn feeding portion 22, the accompanying member 24 is lowered at the timing as mentioned above and thus is not engaged with the engaging surface 104 on the upper sides of the control arms 70, 72 provided at the upper portion of the plating carrier 13. Due to this, the control-arm connecting plate 106 interconnecting the pair of right and left control arms 70, 72 is not displaced and the rotary cam 56 is not rotated, either (See FIG. 9-*a*).

Second, description will be given on the case where the plating carrier 13 is accompanied by the carrier accompanying means 14 mounted on the carriage 8, with the yarn feeding portion 22 provided at the lower end of the plating carrier 13 being reversed.

For the accompany of the plating carrier 13, the carriage 8 is traveled and the accompanying member 24 of the carrier accompanying means 14 is lowered under control of the output signals from the control unit, not shown. The accompanying member 24 is lowered at the time at which the accompanying member 24 is frontward of the position A of FIG. 3 when the plating carrier 13 is accompanied leftwards. On the other hand, the accompanying member 24 is lowered at the time at which the accompanying member 24 is frontward of the position D of FIG. 3 when the plating carrier 13 is accompanied rightwards. The cam plate 92 of the lowering means 28 is swung about the axis of the pivot pin 96 in the direction of the plating carrier 13 in association with the lowering of the accompanying member 24.

When the carriage 8 is traveled further, the side surface of the accompanying member 24 lowered is brought into engagement with the engaging surface 104 on the upper side of the control arm 70, 72 positioned upstream with respect to the traveling direction of the pair of right and left carriages arranged at the upper portion of the plating carrier 13, so that the accompanying member 24 allows the control arms 70, 72 to slidably move.

Since the control arms 70, 72 are slidably fitted in the arched slots 74, 76 formed in the carrier base 25, the control arms 70, 72 are raised first in the state of being pressed by the accompanying member 24, laying down a circular trail and then lowered. This can ensure that the control arms 70, 72 are slidingly moved, without being disengaging from the accompanying member 24 in the middle of the movement.

As shown in FIG. 9*b*, when the control arms 70, 72 are slidingly moved by the accompanying member 24, the control-arm connecting plate 106 interconnecting the control arms 70, 72 is slidingly moved leftwards. As a result of this shift of the control-arm connecting plate 106, the rotary cam 56 loosely fitted in between the two lugs 122, 123 formed on the upper end of the control-arm connecting plate 106 is rotated the 90° turn in the clockwise direction as viewed from the top of the carrier. This brings the recess 130 formed in the lower end of the control-arm connecting plate 106 and the engaging arm 128 of the connecting-plate retaining portion 126 mounted in the feeder case 40 into engagement with each other.

The accompanying member 24 is raised while slidingly moving along the lugs 78, 80 formed on the upper end of the carrier base 25 in the middle of moving while pressing the control arms 70, 72. As shown in FIG. 4, when the control arms 70, 72 are positioned in the direction of the center of the carrier, the upper ends of the control arms 70, 72 are level with or lower than the lugs 78, 80 formed on the carrier base 25. Thus, after the accompanying member 24 is raised up to the top end of the lug 78, 80, it is slidingly moved along the top surface of the control arm 70, 72.

Then, the depressing cam 98 formed on the lower end of the cam plate 92 of the lowering means 28 is abutted with the upper end of the depressing portion 48 of the feeder rod 32, so as to press down the feeder rod 32. This causes the yarn feeding portion 22 at the lower end of the feeder rod 32 to project from the tip of the feeder rod guide 34.

At that time, as shown in FIG. 9*c*, the rotary cam 56 as was caused to rotate the 90° turn in the clockwise direction as viewed from the top of the carrier by the shift of the control-arm connecting plate 106 is brought into abutment with the cam surface 140 of the auxiliary rotary cam 136 provided under the rotary cam 56, whereby the rotary cam 56 is caused to rotate the remaining turn until the yarn feeding portion 22 is revered. When the feeder rod 32 is lowered, the engagement between the control-arm connecting plate 106 and the engaging arm 128 of the connecting-plate retaining portion 126 is released, but since the connecting-plate locking cam 134 of the rotary cam 56 is put into abutment with the right side surface 138 of the right-side lug 122 on the upper end of the control-arm connecting plate 106 during the rotary cam 56 being in contact with the cam surface 140 of the auxiliary rotary cam 136, the control-arm connecting plate 106 is held in the same place.

Then, the accompanying member 24 is brought into abutment with the side surface of the swinging arm 82 positioned downstream with respect to the traveling direction of the carriage 8, so that the plating carrier 13 is accompanied by the carriage 8.

When the carriage 8 is in the position in which the plating carrier 13 is released or the other yarn carrier 12 is operated, the accompanying member 24 is raised under control of the output signals from the control unit not shown. Along with the rising of the accompanying member 24, the cam plate 92 of the lowering means 28 is swung about the axis of the pivot pin 96 to its tip-up position.

When the engagement between the accompanying member 24 and the side surface of the swinging arm 82 positioned downstream with respect to the traveling direction of the carriage 8 and located in the direction of the center of the carrier is released by the rise of the accompanying member 24, the plating carrier 13 is released. Also, as a result of the cam plate 92 being swung to its tip-up position, the feeder rod 32 as has been pressed down until that time is pressed up to the position where the yarn feeding portion 22 at the lower end of the feeder rod does not interfere with any yarn feeding portion of the other yarn feeder 12 or the knitting needle 6, sinker or equivalent by the spring 38.

The rise of the feeder rod 32 causes the rotary cam 56 and the auxiliary rotary cam 136 to be away from each other, with the result that the control-arm connecting plate 106 is slidingly moved rightward by the biasing force of the spring. When the control-arm connecting plate 106 is slidingly moved, the connecting-plate locking cam 134 of the rotary cam 56 causes the rotary cam 56 to be rotated in the counterclockwise direction as viewed from the top of the carrier by the right side lug 122 on the upper end of the control-arm connecting plate 106. As a result of this, as shown in FIG. 9-*a*, the first rotary cam 132 of the rotary cam 56 is put in the state of loosely fitted in between the two lugs 122, 123 formed on the upper end of the control-arm connecting plate 106 again. Then, the pair of right and left control arms 70, 72 on the upper portion of the plating carrier 13 are returned to their positions in the direction of outside of the carrier.

In this embodiment as illustrated above, the horizontal shift of the control-arm connecting plate 106 and the vertical shift of the feeder rod 32 are both used in combination for the reverse of the yarn feeding portion 22 at the lower end of the plating carrier 13, thus enabling the plating carrier 13 to be reduced in size.

While in this embodiment, the yarn feeding portion 22 is caused to rotate the 90° turn by the rotation of the rotary cam 56 caused by the shift of the control-arm connecting plate 106, first, and then is caused to rotate in the remaining 90° turn until the yarn feeding portion 22 is reversed by the rotary cam 56 being brought into abutment with the cam surface 140 of the auxiliary rotary cam 136 when the feeder rod 32 is lowered, the ratio at which the yarn feeding portion is caused to rotate by the shift of the control-arm connecting plate 106 need not be necessarily identical with the ratio at which the yarn feeding portion is caused to rotate by the auxiliary rotary cam 136.

While in this embodiment, the control arms 70, 72 are biased outwardly with respect to the traveling direction of the carrier by the spring 120, the control arms 70, 72 may be biased inwardly with respect to the traveling direction of the carrier. In the case where the control arms 70, 72 are biased inwardly with respect to the traveling direction of the carrier, the control arms 70, 72 are caused to be slidingly shifted outwardly with respect to the traveling direction of the carrier by the accompanying member 24.

(Variant)

Figure 13:
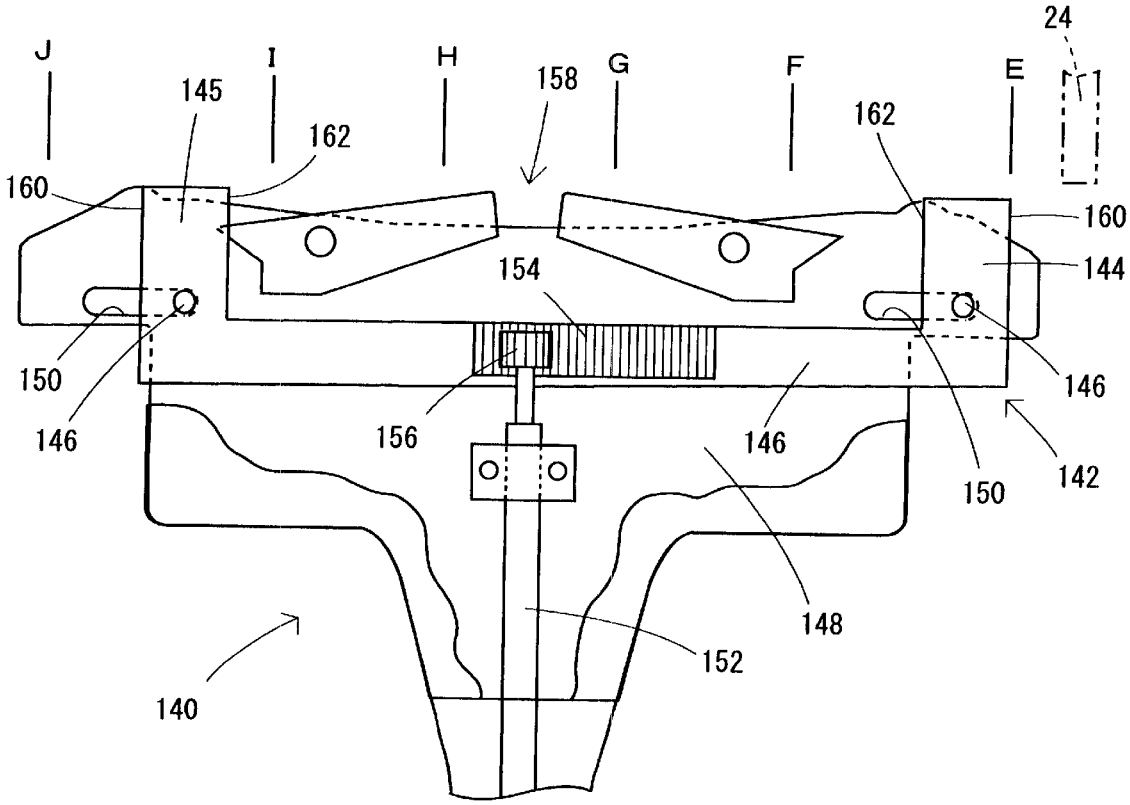
FIG. 13 shows a schematic front view of another yarn feeding device of the flat knitting machine of a variant of the present invention.
Figure 14:
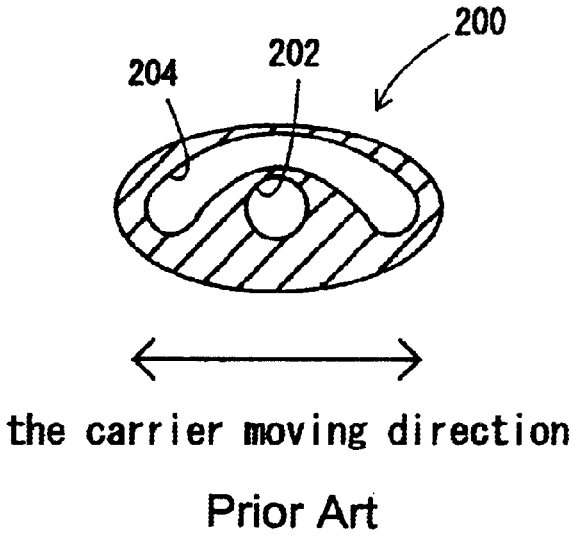
FIG. 14 shows a sectional view of the yarn feeding means of the prior art.
Figure 15:
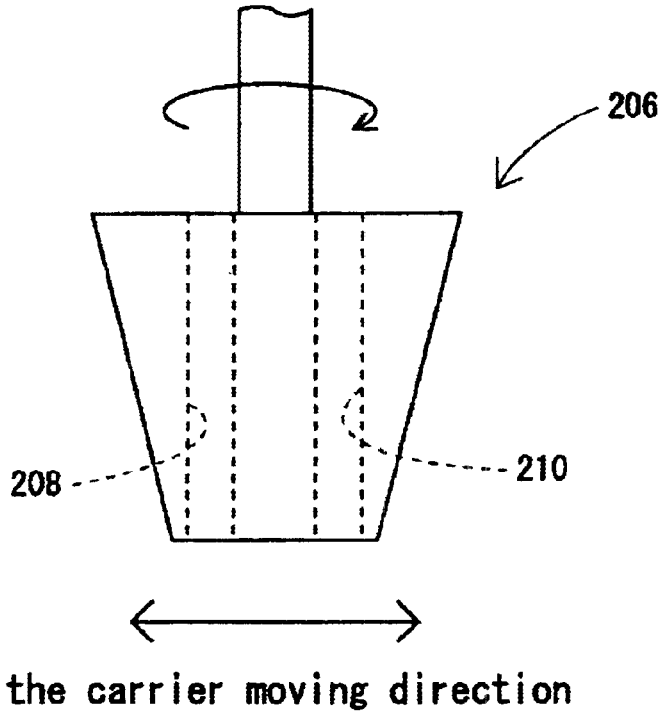
Prior Art Fig. 15
FIG. 15 shows a side view of the yarn feeding means of the prior art.

A variant of the present invention will be described with reference to the drawing figure. FIG. 13 shows a schematic front view of a plating carrier 140 partly drawn in perspective.

In this embodiment, a pair of right and left control arms 144, 145 and a control-arm connecting plate 145, which form reciprocating means 142, are formed into one piece in a U-shape.

Pins 146 on the control arms 144, 145 are inserted in slots 150 formed in a carrier base 148 so that the reciprocating means 142 can slide in a traveling direction of a carrier. Movement conversion means for converting reciprocal movement of the reciprocating means 142 into rotational movement of the yarn feeding portion (not shown) provided in the feeder rod 152 comprises a rack 152 formed on the front side of the control-arm connecting plate 146 to extend along the traveling direction of the carrier and a pinion 156 provided on the upper end of the feeder rod 152. When the reciprocating means 142 is moved in reciprocation in the traveling direction of the carrier, the pinion 156 on the upper end of the feeder rod 152 is rotated, and as such can allow the yarn feeding portion at the lower end of the feeder rod 152 to rotate about an axis of the longitudinal direction of the feeder rod 152 serving as a rotation axis.

For example, as shown in FIG. 13, when the reciprocating means 142 is positioned at the right side with respect to the traveling direction of the carrier, the yarn feeding portion is in the non-reversed position, while on the other hand, when the reciprocating means 142 is positioned at the left side with respect to the traveling direction of the carrier, the yarn feeding portion is in the reversed position.

Now, description will be given on the case where the plating carrier 140 is accompanied by the carrier accompanying means 14 mounted on the carriage 8.

First, suppose that the plating carrier 140 is accompanied, with the position of the reciprocating means 142 being kept unchanged. When the carriage 8 is moved leftwards, the accompanying member 24 of the carrier accompanying means 14 is lowered at the time at which the accompanying member 24 is between the positions E–G. On the other hand, when the carriage 8 is moved rightwards, the accompanying member 24 of the carrier accompanying means 14 is lowered at the time at which the accompanying member 24 is between the positions J-H. The accompanying member 24 is engaged with the engaging portion 158 on the upper portion of the carrier base 148, to accompany the plating carrier 140.

Second, suppose that the plating carrier 140 is accompanied by rotating the yarn feeding portion, with the reciprocating means 142 being in the position opposite to the traveling direction of the carrier. When the carriage 8 is moved leftwards, the accompanying member 24 of the carrier accompanying means 14 is lowered at the time at which the accompanying member 24 is frontward of the position E. On the other hand, when the carriage is moved rightwards, the accompanying member 24 of the carrier accompanying means 14 is lowered at the time at which the accompanying member 24 is frontward of the position J. This enables the accompanying member 24 to engage with the engaging surfaces 160 on the outside surfaces of the control arms 144, 145 of the reciprocating means 142 in the traveling direction of the carrier, and as such can allow the reciprocating means 142 to slidingly move toward the traveling direction of the carrier. This causes the yarn feeding portion to rotate. Then, the accompanying member 24 is engaged with the engaging portion 158 formed on the upper portion of the carrier base 148, to accompany the plating carrier 140.

Further, suppose that the plating carrier 140 is accompanied, with the reciprocating means 142 being in the position opposite to the traveling direction of the carrier, first, and, then, the plating carrier 140 is accompanied, with the reciprocating means 142 being in the position opposite to the traveling direction of the carrier even in the next knitting course for which the traveling direction of the carriage 8 is switched. When the traveling direction of the plating carrier 140 is switched from left to right, the accompanying member 24 is raised after the leftward knitting is ended, so as to release the plating carrier 140 therefrom, first. Then, the accompanying member 24 is lowered at the time at which the accompanying member 24 is between the positions H–I, to drive the carriage 8. This brings the accompanying member 24 into engagement with the engaging surface 162 formed on the inside surface of the control arm 145 of the reciprocating means 142 with respect to the traveling direction of the carrier, so as to cause the reciprocating means 142 to slidingly move to the traveling direction of the carrier. This causes the yarn feeding portion to rotate. Then, the accompanying member 24 is raised again at the position J.

When the traveling direction of the plating carrier 140 is switched from right to left, the accompanying member 24 is raised after the rightward knitting is ended, so as to release the plating carrier 140 therefrom, first. Then, the accompanying member 24 is lowered at the time at which the accompanying member 24 is between the positions G-F, to drive the carriage 8. This brings the accompanying member 24 into engagement with the engaging surface 162 formed on the inside surface of the control arm 144 of the reciprocating means 142 with respect to the traveling direction of the carrier, so as to cause the reciprocating means 142 to slidingly move to the traveling direction of the carrier. This causes the yarn feeding portion to rotate. Then, the accompanying member 24 is raised again at the position E.

It should be noted that while in the embodiments illustrated above, the yarn feeding portion at the lower end of the feeder rod is rotated the 180° turn in the traveling direction of the carrier, the rotation of the yarn feeding portion need not be necessarily limited to the 180° turn. Also, the main yarn and the plating yarn may be arranged in the direction intersecting with the traveling direction of the carrier.

While in the previous embodiments, the feeder rod is lowered to get the yarn feeding portion close to the knitting needle, the present invention may practicably be embodied, for example, by using another carrier that requires no lowering of the yarn feeding portion.

While in the embodiments illustrated above, the yarn feeding portion having the main-yarn hole and the plating-yarn hole is rotated about its axis, modification may be made such that either of the main-yarn hole and the plating-yarn hole is fixed and only the other of the main-yarn hole and the plating-yarn hole is rotated about an axis of the yarn feeding portion, whereby the main-yarn hole and the plating-yarn hole are changed over positions.

While preferred embodiments of the invention have been illustrated above, it is to be understood that the present invention is not limited thereto but may practicably be embodied variously within the sprit and scope of the present invention.

Capabilities of Exploitation in Industry

As mentioned above, according to the present invention, the accompanying member of the carrier accompanying means is engaged with the reciprocating means, to cause the movement of the reciprocating means, whereby the positional relationship between the main-yarn feeding hole and the plating-yarn feeding hole provided in the yarn feeding portion of the plating carrier can be changed. The main-yarn feeding hole and the plating-yarn feeding hole can be controllably changed over positions by changing the timing at which the accompanying member of the carrier accompanying means is lowered. This enables the main-yarn feeding hole and the plating-yarn feeding hole to be changed over positions at any selective location, irrespective of the direction of knitting. This yarn feeding device can provide the fabric knitting that has been impossible so far and a novel fabric knitting.

Also, according to the present invention, the movement conversion means comprises the rotary cam and the auxiliary rotary cam; the rotary cam is rotated a predetermined turn by movement of the reciprocating means; and the rotary cam or the auxiliary rotary cam is vertically moved to bring the rotary cam into abutment with the auxiliary rotary cam, whereby the rotary cam is rotated the remaining turn until the yarn feeding portion is reversed.

The means for reversing the yarn feeding portion is separated into the movement by the reciprocating means and the abutment of the rotary cam and the auxiliary rotary cam forming the movement conversion means, whereby the reciprocating means for causing rotation of the rotary cam is reduced in distance, thus reducing the yarn carrier in size to that extent.

What is claimed is:

1. A yarn feeding device of a flat knitting machine comprising at least a pair of front and back needle beds which are so disposed that their front ends confront each other in an abutment relation; a number of knitting needles arranged in line on the needle beds in such a manner as to be freely advanced and retracted; a yarn guide rail arranged over the needle beds to extend in parallel with a longitudinal dimension of the needle beds; a yarn carrier for feeding a yarn to the knitting needle which is movably arranged in the yarn guide rail; carrier accompanying means including an accompanying member for releasing the yarn carrier from accompaniment at any position of the needle beds, the yarn carrier comprising:

a carrier base having, at an upper end on a center side thereof, an engaging portion engageable with the accompanying member of the carrier accompanying means and supported on the yarn guide rail in such a manner as to move in reciprocation along the longitudinal dimension of the needle beds;

reciprocating means supporting on the carrier base in such a manner as to move in reciprocation with respect to a traveling direction of the carrier base and having, at an outside of the engaging portion of the carrier base with respect to the traveling direction, an engaging surface temporarily engageable with the accompanying member of the carrier accompanying means;

feeder means having, at its front end, a main-yarn feeding hole and a plating-yarn feeding hole, extending vertically downwardly from the carrier base, and supporting at least one of the yarn feeding holes in such a manner as to freely rotatable about an axis in a longitudinal direction of the feeder means; and movement conversion means for converting reciprocating movement of the reciprocating means into rotation movement of the yarn feeding holes provided in the feeder means in such a manner that when the reciprocating means is moved with its engaging surface engaged with the accompanying member, the yarn feeding holes of the feeder means can be rotationally displaced to change a positional relationship between the main-yarn feeding hole and the plating-yarn feeding hole over a needle bed gap between the needle beds, wherein the carrier accompanying means is electrically controlled so that when the yarn carrier is accompanied by the accompanying member and/or is released from the accompaniment, the carrier accompanying means can be selectively engaged with or disengaged from the engaging surface of the reciprocating means.

2. The yarn feeding device of the flat knitting machine according to claim 1, wherein the movement conversion means comprises a rotary cam that is rotated by movement of the reciprocating means and an auxiliary rotary cam arranged under or over the rotary cam; the rotary cam is rotated a predetermined turn by the movement of the reciprocating means; and then the rotary cam or the auxiliary rotary cam is vertically moved to bring the auxiliary rotary cam into abutment with the rotary cam, whereby the rotary cam is rotated the remaining turn until the feeder means is reversed.

* * * * *